US009422124B2

(12) United States Patent
Tamura et al.

(10) Patent No.: US 9,422,124 B2
(45) Date of Patent: Aug. 23, 2016

(54) SHEET CONVEYING ROLLER

(71) Applicant: SUMITOMO RUBBER INDUSTRIES, LTD., Kobe-shi, Hyogo (JP)

(72) Inventors: Toshihiro Tamura, Kobe (JP); Akihiro Mine, Kobe (JP); Masahiro Yoshizato, Kobe (JP)

(73) Assignee: SUMITOMO RUBBER INDUSTRIES, LTD., Kobe-shi (JP)

( * ) Notice: Subject to any disclaimer, the term of this patent is extended or adjusted under 35 U.S.C. 154(b) by 202 days.

(21) Appl. No.: 14/321,155

(22) Filed: Jul. 1, 2014

(65) Prior Publication Data

US 2015/0024915 A1 Jan. 22, 2015

(30) Foreign Application Priority Data

Jul. 16, 2013 (JP) ..... 2013-147729

(51) Int. Cl.
*B65H 3/06* (2006.01)
*G03G 15/00* (2006.01)
*B65H 27/00* (2006.01)

(52) U.S. Cl.
CPC ..... *B65H 3/0638* (2013.01); *B65H 27/00* (2013.01); *G03G 15/6511* (2013.01); *B65H 2401/10* (2013.01); *B65H 2401/23* (2013.01); *B65H 2404/18* (2013.01); *B65H 2701/1912* (2013.01); *G03G 2215/00683* (2013.01)

(58) Field of Classification Search
CPC ..... B65H 2401/10; B65H 2401/11; B65H 3/0638; B65H 27/00; B65H 2701/1912; B65H 2401/23; B65H 2401/231; B65H 2401/2311; B65H 2404/18; B65H 2404/185; G03G 15/6511; G03G 2215/00683
See application file for complete search history.

(56) References Cited

U.S. PATENT DOCUMENTS 4,801,134 A * 1/1989 Yokoyama ..... B65H 3/46 271/122
5,725,209 A * 3/1998 Takahashi ..... B65H 3/5261 271/109
6,273,415 B1 * 8/2001 Tengo ..... B65H 27/00 271/109
6,491,613 B2 * 12/2002 Takeda ..... C08C 19/25 492/56
6,939,279 B2 * 9/2005 Shea ..... B65H 27/00 492/39
7,284,649 B2 * 10/2007 Shiraki ..... B65H 27/00 193/35 R
7,448,610 B2 * 11/2008 Ito ..... B65H 3/0638 271/109
7,497,433 B2 * 3/2009 Nagao ..... B65H 3/5261 271/125

(Continued)

FOREIGN PATENT DOCUMENTS

JP 05-024675 A 2/1993
JP 2001-341862 A 12/2001

(Continued)

*Primary Examiner* — Jason L Vaughan
(74) *Attorney, Agent, or Firm* — Birch, Stewart, Kolasch & Birch, LLP

(57) ABSTRACT

The inventive sheet conveying roller has a double-layer structure including a tubular outer layer and an inner layer inserted directly in the tubular outer layer without the intervention of an adhesive agent. The sheet conveying roller includes a roller body of a double-layer structure including a tubular outer layer (6) of a urethane thermoplastic elastomer and an inner layer (7) of a rubber such as IIR inserted directly in the tubular outer layer (6) without the intervention of an adhesive agent. The outer layer (6) has a Type-A Durometer hardness of not less than 40 and not greater than 65, and the inner layer (7) has a Type-A Durometer hardness of greater than 10 and not greater than 25.

3 Claims, 1 Drawing Sheet

(56) References Cited

U.S. PATENT DOCUMENTS

| | | | | |
|---|---|---|---|---|
| 8,900,108 | B2 * | 12/2014 | Mine | B65H 27/00 492/53 |
| 8,986,182 | B2 * | 3/2015 | Tamura | F16C 13/00 492/48 |
| 2006/0082042 | A1 | 4/2006 | Ito et al. | |
| 2007/0096383 | A1 * | 5/2007 | Nishimura | B65H 3/0638 271/109 |
| 2007/0111873 | A1 | 5/2007 | Ito et al. | |

FOREIGN PATENT DOCUMENTS

| | | | |
|---|---|---|---|
| JP | 2006-111401 | A | 4/2006 |
| JP | 2007-137539 | A | 6/2007 |
| JP | 2008-114935 | A | 5/2008 |
| JP | 4593445 | B2 | 12/2010 |

* cited by examiner

SHEET CONVEYING ROLLER

BACKGROUND OF THE INVENTION

1. Field of the Invention

The present invention relates to a sheet conveying roller to be used for conveying a sheet, for example, in a laser printer or the like.

2. Description of the Related Art

Various types of sheet conveying rollers are incorporated in a sheet conveying mechanism provided, for example, in an image forming apparatus such as a laser printer, an electrostatic copying machine, a plain paper facsimile machine, a copier-printer-facsimile multifunction machine or an inkjet printer, or machinery such as an automatic teller machine (ATM).

Examples of the sheet conveying rollers include a sheet feed roller, a transport roller, a platen roller and a sheet output roller, which are each adapted to be rotated in frictional contact with a sheet (the term "sheet" is herein defined to include a paper sheet, a plastic film and the like, and this definition is effective in the following description) to convey the sheet.

Such a conventional sheet conveying roller typically includes a tubular single-layer roller body made of an elastic material such as a crosslinking product of a rubber and having an outer peripheral surface serving as a contact surface to be brought into contact with a sheet, and a shaft inserted in a center through-hole of the roller body.

However, as the number of sheets conveyed by the sheet conveying roller is increased, the outer peripheral surface of the single-layer roller body of the sheet conveying roller is more liable to have a reduced friction coefficient with respect to a sheet. Problematically, this may result in sheet conveying failure and so-called squeal which is caused when a sheet slips on the outer peripheral surface.

To eliminate these problems, Japanese Patent No. 4593445 discloses a roller body which has a double-layer structure including a tubular non-porous inner layer and a tubular non-porous outer layer, the inner layer being made of a crosslinking product of a butyl rubber (for example, isobutylene-isoprene rubber: IIR) and having a Type-A Durometer hardness (JIS-A hardness) of not greater than 10, the outer layer being made of a crosslinking product of an ethylene propylene rubber, a silicone rubber or a urethane rubber and having a Type-A Durometer hardness of 25 to 60.

That is, the inner layer, which is a softer layer as described above, permits deformation of the outer layer to provide a sufficient contact area between the outer peripheral surface of the roller body and a sheet while suppressing the reduction in friction coefficient. The outer layer, which is harder than the inner layer, ensures proper balance between the abrasion resistance and the friction coefficient of the roller body. In addition, IIR is excellent in vibration damping property. This prevents the sheet conveying failure and the squeal for a longer period of time from the initial stage of use as compared with a case in which the roller body has the conventional single-layer structure.

For simplification of the structure of the sheet conveying roller and the production process for the sheet conveying roller, the inner layer and the outer layer are generally unified with each other by inserting the inner layer directly into the tubular outer layer without the intervention of an adhesive agent.

In recent years, there is a demand for using a thermoplastic elastomer as a base polymer for formation of the roller body of the sheet conveying roller. The thermoplastic elastomer is thermoplastic and hence easy to recycle.

To meet the demand, it is contemplated to form the outer layer of the roller body of the double-layer structure from a composition containing a urethane thermoplastic elastomer.

In this case, however, the inner layer inserted directly in the outer layer without the intervention of the adhesive agent is liable to slip-rotate with respect to the outer layer, thereby making it impossible to convey a sheet.

One conceivable cause of this problem is that the outer layer made of the urethane thermoplastic elastomer is liable to have lower stretchability than the conventional outer layer made of the crosslinking product of the urethane rubber or other rubber and have insufficient adhesiveness to the inserted inner layer.

More specifically, a great amount of oil should be added to the material for the inner layer in order to impart the inner layer with a Type-A Durometer hardness of not greater than 10. This results in bleeding of excess oil from the inner layer to reduce the adhesiveness.

Where the outer layer is made of the crosslinking product of the urethane rubber or other rubber as described in Japanese Patent No. 4593445, the outer layer is kept in intimate contact with the inner layer by sufficient stretchability thereof and, therefore, is substantially free from slip-rotation with respect to the inner layer.

However, the outer layer made of the less stretchable urethane thermoplastic elastomer has lower adhesiveness with respect to the inner layer and, therefore, is more likely to suffer from slip-rotation which may be caused by the influence of the oil bleeding out of the inner layer.

It is an object of the present invention to provide a sheet conveying roller which has a double-layer structure including a tubular outer layer and an inner layer inserted directly in the tubular outer layer without the intervention of an adhesive agent, and is excellent in various characteristic properties because of its double-layer structure and substantially free from slip-rotation between the inner layer and the outer layer though the outer layer is made of a urethane thermoplastic elastomer.

SUMMARY OF THE INVENTION

The present invention provides a sheet conveying roller including a tubular roller body, which includes a tubular outer layer defining an outer peripheral surface of the roller body, and a tubular inner layer inserted directly in the tubular outer layer and unified with the outer layer, wherein the outer layer is a nonporous tubular layer made of a composition comprising a urethane thermoplastic elastomer as a base polymer, and has a Type-A Durometer hardness of not less than 40 and not greater than 65, wherein the inner layer is a nonporous tubular layer made of a crosslinking product of a composition comprising a butyl rubber or an ethylene propylene rubber as a base polymer, and has a Type-A Durometer hardness of greater than 10 and not greater than 25.

According to the present invention, the roller body has a double-layer structure including the inner layer and the outer layer. The inner layer has a Type-A Durometer hardness of not greater than 25 to be thereby imparted with proper flexibility, permitting deformation of the outer layer. This makes it possible to provide a sufficient contact area between the outer peripheral surface of the roller body and a sheet while suppressing reduction in friction coefficient. Further, the outer layer has a Type-A Durometer hardness of not less than 40 and not greater than 65, which is higher than that of the inner layer, thereby ensuring proper balance between the abrasion resistance and the friction coefficient of the roller body. This makes it possible to continuously prevent the sheet conveying failure and the squeal for a longer period of time from the initial stage of use as compared with a case in which the roller body has a single-layer structure.

In addition, the Type-A Durometer hardness of the inner layer is greater than 10. Therefore, the proportion of oil to be blended in the composition for the inner layer can be reduced as compared with the conventional case, thereby suppressing the bleeding of excess oil from the inner layer. Although the outer layer is made of the urethane thermoplastic elastomer, the slip-rotation between the outer layer and the inner layer can be prevented.

In order to impart the outer layer with a Type-A Durometer hardness of not less than 40 and not greater than 65, the outer layer is preferably formed of a composition prepared by blending not less than 30 parts by mass and not greater than 110 parts by mass of a plasticizer with 100 parts by mass of a urethane thermoplastic elastomer having a Type-A Durometer hardness of not less than 60 and not greater than 80.

In the present invention, the Type-A Durometer hardness is defined as a value determined at a measurement temperature of 23° C. by a measurement method specified by Japanese Industrial Standards JIS K6253-3:2006 "Rubber, vulcanized or thermoplastic—determination of hardness—Part 3: Durometer Hardness."

According to the present invention, the sheet conveying roller can be provided, in which the roller body has a double-layer structure including the outer layer and the inner layer inserted directly in the tubular outer layer without the intervention of an adhesive layer, and is excellent in various characteristic properties because of its double-layer structure and substantially free from slip-rotation between the inner layer and the outer layer though the outer layer is made of the urethane thermoplastic elastomer.

DETAILED DESCRIPTION OF PREFERRED EMBODIMENTS

Figure 1:
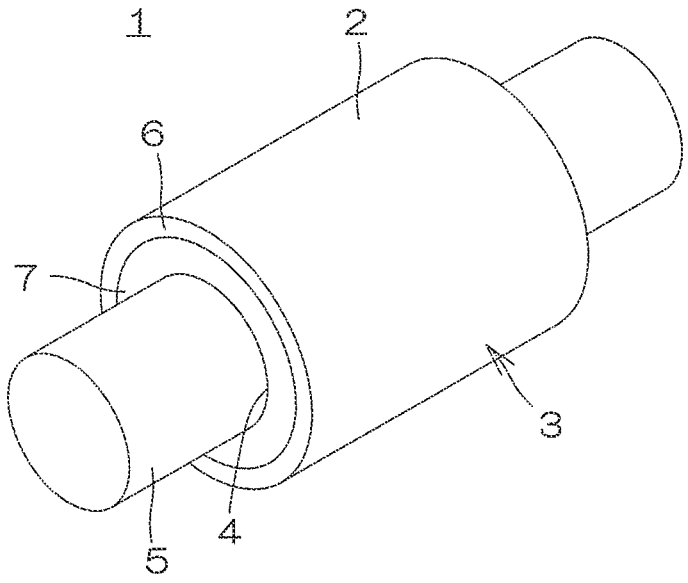
FIG. 1 is a perspective view showing an exemplary appearance of a sheet conveying roller according to one embodiment of the present invention.

FIG. 1 is a perspective view showing an exemplary appearance of a sheet conveying roller according to one embodiment of the present invention.

Referring to FIG. 1, the sheet conveying roller 1 according to this embodiment includes a tubular roller body 3 having an outer peripheral surface 2 serving as a contact surface to be brought into contact with a paper sheet, and a shaft 5 inserted in a center through-hole 4 of the roller body 3. The shaft 5 is formed of, for example, a metal, a ceramic material, a hard resin or the like.

The roller body 3 includes a tubular outer layer 6 defining the outer peripheral surface 2 of the roller body 3, and a tubular inner layer 7 inserted directly in the tubular outer layer 6 without the intervention of an adhesive agent and unified with the outer layer 6.

<Inner Layer 7>

The inner layer 7 is a nonporous tubular layer made of a crosslinking product of a composition containing IIR or an ethylene propylene rubber as a base polymer, and is required to have a Type-A Durometer hardness of greater than 10 and not greater than 25.

If the inner layer 7 is to be imparted with a Type-A Durometer hardness not greater than the aforementioned range, a great amount of oil should be blended with the composition for the inner layer 7. Therefore, as described above, excess oil is liable to bleed out of the inner layer 7, thereby significantly reducing the adhesiveness of the outer layer 6 of the urethane thermoplastic elastomer to the inner layer 7. Therefore, slip-rotation is liable to occur between the layers 6 and 7, resulting in sheet conveying failure.

If the Type-A Durometer hardness of the inner layer 7 is greater than the aforementioned range, on the other hand, the inner layer 7 is too hard. Accordingly, the inner layer 7 cannot permit the deformation of the outer layer 6, making it impossible to provide a sufficient contact area between the outer peripheral surface 2 of the roller body 3 and a paper sheet while suppressing the reduction in friction coefficient. Therefore, the inner layer 7 fails to provide the effect of preventing the sheet conveying failure and the squeal for a longer period of time from the initial stage of use.

Where the Type-A Durometer hardness of the inner layer 7 is greater than 10 and not greater than 25, in contrast, it is possible to prevent the sheet conveying failure and the squeal for a longer period of time from the initial stage of use while preventing the slip-rotation between the outer layer 6 and the inner layer 7.

For further improvement of this effect, the Type-A Durometer hardness of the inner layer 7 is preferably not less than 10.5 and not greater than 20, particularly preferably not less than 13 and not greater than 18, within the aforementioned range.

The inner layer 7 is formed by preparing a composition by blending the IIR or the ethylene propylene rubber as the base polymer, a crosslinking component such as a crosslinking agent, an accelerating agent and/or an acceleration assisting agent, and additives such as oil and a filler, forming the composition into a tubular body and crosslinking the composition, for example, through a press crosslinking process and, as required, cutting the tubular body to a predetermined length and polishing the outer peripheral surface.

The inner layer 7 preferably has a thickness of not less than 1 mm and not greater than 3 mm as measured radially of the roller body 3.

If the thickness of the inner layer 7 is less than the aforementioned range, the inner layer 7 fails to sufficiently provide the aforementioned effect. If the thickness of the inner layer 7 is greater than the aforementioned range, the roller body 3 is liable to cause deflection due to uneven abrasion thereof.

(IIR)

Any of various copolymers of isobutylene and isoprene may be used either alone or in combination as the IIR. Particularly, the IIR preferably has an isoprene content of not less than 1.5 mass % and not greater than 4.5 mass %.

Specific examples of the IIR include JSR BUTYL 268 (stabilizer NS type having an unsaturation degree of 1.5 mol %, a Mooney viscosity of 51 $ML_{1+8}$ (at 125° C.) and a specific gravity of 0.92) and JSR BUTYL 365 (stabilizer NS type having an unsaturation degree of 2.0 mol %, a Mooney viscosity of 33 $ML_{1+8}$ (at 125° C.) and a specific gravity of 0.92) available from JSR Co., Ltd.

(Ethylene Propylene Rubber)

Usable examples of the ethylene propylene rubber include ethylene propylene rubbers (EPM), in a narrow sense, which are copolymers of ethylene and propylene, and ethylene propylene diene rubbers (EPDM) which are copolymers of ethylene, propylene and a diene. Particularly, the EPDM is preferred.

Any of various copolymers of ethylene, propylene and a diene are usable as the EPDM. Examples of the diene include ethylidenenorbornene (ENB) and dicyclopentadiene (DCPD).

The EPDM may be either an oil-extension EPDM extended with an extension oil or a non-oil-extension EPDM not extended with an extension oil.

Exemplary ENB-type oil-extension EPDMs in which the diene is ENB include ESPRENE (registered trade name) 670F (having a mass ratio of rubber:extension oil=100:100) and ESPRENE 671F (having a mass ratio of rubber:extension oil=100:70) available from Sumitomo Chemical Co., Ltd., and MITSUI EPT3042E (having a mass ratio of rubber:extension oil=100:120) available from Mitsui Chemicals, Inc.

An exemplary DCPD-type oil-extension EPDM in which the diene is DCPD is ESPRENE 400 (having a mass ratio of rubber:extension oil=100:100) available from Sumitomo Chemical Co., Ltd.

Exemplary ENB-type non-oil-extension EPDMs in which the diene is ENB include ESPRENE 501A and ESPRENE 505A available from Sumitomo Chemical Co., Ltd.

Exemplary DCDP-type non-oil-extension EPDMs in which the diene is DCDP include ESPRENE 301A, ESPRENE 301 and ESPRENE 305 available from Sumitomo Chemical Co., Ltd.

These exemplary EPDMs may be used either alone or in combination.

(Oil)

Examples of the oil include paraffin oil such as DIANA (registered trade name) PROCESS OIL PW-380 available from Idemitsu Kosan Co., Ltd. and other various oils highly compatible with the IIR and the ethylene propylene rubber.

(Filler)

Examples of the filler include silica, carbon, carbon black, clay, talc, calcium carbonate, magnesium carbonate, aluminum hydroxide and titanium oxide, which may be used either alone or in combination.

(Proportions of Oil and Filler)

The proportions of the oil and the filler may be set as desired.

The oil and the filler may be blended in proportions such that the inner layer 7 has a Type-A Durometer hardness of greater than 10 and not greater than 25 after the crosslinking, according to the type and the grade of the IIR or the ethylene propylene rubber as the base polymer or the type of the ethylene propylene rubber (the oil-extension type or the non-oil-extension type).

Where the ethylene propylene rubber is an oil-extension rubber, the proportion of the oil is defined as the total proportion of the extension oil and the additive oil based on 100 parts by mass of the solid component of the oil-extension rubber, i.e., the ethylene propylene rubber per se.

(Crosslinking Component)

The crosslinking component for crosslinking the IIR or the ethylene propylene rubber as the base polymer includes the crosslinking agent, and at least one of the accelerating agent and the acceleration assisting agent to be used in combination with the crosslinking agent.

Examples of the crosslinking agent include a sulfur crosslinking agent, a thiourea crosslinking agent, a triazine derivative crosslinking agent, a peroxide crosslinking agent and monomers, which may be used either alone or in combination.

Examples of the sulfur crosslinking agent include sulfur powder and organic sulfur-containing compounds. Examples of the organic sulfur-containing compounds include tetramethylthiuram disulfide and N,N-dithiobismorpholine.

Examples of the thiourea crosslinking agent include tetramethylthiourea, trimethylthiourea, ethylene thiourea, and thioureas represented by $(C_nH_{2n+1}NH)_2C{=}S$ (wherein n is an integer of 1 to 10).

Examples of the peroxide crosslinking agent include benzoyl peroxide and the like.

Examples of the accelerating agent include inorganic accelerating agents such as lime, magnesia (MgO) and litharge (PbO), and organic accelerating agents, which may be used either alone or in combination.

Examples of the organic accelerating agents include a guanidine accelerating agent, a thiazole accelerating agent, a sulfenamide accelerating agent, a thiuram accelerating agent, a thiourea accelerating agent and a dithiocarbamate accelerating agent, which may be used either alone or in combination. Different types of accelerating agents have different crosslinking accelerating mechanisms and, therefore, are preferably used in combination.

Examples of the guanidine accelerating agent include 1,3-diphenylguanidine (D), 1,3-di-o-tolylguanidine (DT), 1-o-tolylbiguanide (BG) and a di-o-tolylguanidine salt of dicatechol borate, which may be used either alone or in combination.

Examples of the thiazole accelerating agent include 2-mercaptobenzothiazole (M), di-2-benzothiazolyl disulfide (DM), a zinc salt of 2-mercaptobenzothiazole (MZ), a cyclohexylamine salt of 2-mercaptobenzothiazole (HM, M60-OT), 2-(N,N-diethylthiocarbamoylthio)benzothiazole (64) and 2-(4'-morpholinodithio)benzothiazole (DS, MDB), which may be used either alone or in combination.

Examples of the sulfenamide accelerating agent include N-cyclohexyl-2-benzothiazylsulfenamide and the like.

Examples of the thiuram accelerating agent include tetramethylthiuram monosulfide (TS), tetramethylthiuram disulfide (TT, TMT), tetraethylthiuram disulfide (TET), tetrabutylthiuram disulfide (TBT-N), tetrakis(2-ethylhexyl)thiuram disulfide (TOT-N) and dipentamethylenethiuram tetrasulfide (TRA), which may be used either alone or in combination.

Examples of the dithiocarbamate accelerating agent include zinc dimethyldithiocarbamate (PZ), zinc diethyldithiocarbamate (EZ), zinc dibutyldithiocarbamate (BZ), zinc N-pentamethylenedithiocarbamate (ZP), zinc dibenzyldithiocarbamate (ZTC), sodium dibutyldithiocarbamate (TP), copper dimethyldithiocarbamate (TTCU), ferric dimethyldithiocarbamate (TTFE) and tellurium diethyldithiocarbamate (TTTE), which may be used either alone or in combination.

Examples of the acceleration assisting agent include: metal compounds such as zinc white; fatty acids such as stearic acid, oleic acid and cotton seed fatty acids; and other conventionally known acceleration assisting agents, which may be used either alone or in combination.

The proportions of the crosslinking agent, the accelerating agent and the acceleration assisting agent are properly determined according to the types, the combination and the proportions of polymers for the base polymer, the types and the combination of the crosslinking agent, the accelerating agent and the acceleration assisting agent, and the required Type-A Durometer hardness of the inner layer 7.

<Outer Layer 6>

The outer layer 6 is a nonporous tubular layer made of a composition containing a urethane thermoplastic elastomer as a base polymer, and is required to have a Type-A Durometer hardness of not less than 40 and not greater than 65.

If the Type-A Durometer hardness of the outer layer 6 is less than the aforementioned range, the outer layer 6 is too soft and, therefore, has lower abrasion resistance, failing to provide the effect of preventing the sheet conveying failure and the squeal for a longer period of time. If the Type-A Durometer hardness of the outer layer 6 is higher than the aforementioned range, on the other hand, the outer layer 6 is too hard and, therefore, liable to suffer from the sheet conveying failure and the squeal, particularly, at the initial stage of use.

Where the Type-A Durometer hardness of the outer layer 6 is not less than 40 and not greater than 65, in contrast, it is possible to prevent the sheet conveying failure and the squeal for a longer period of time from the initial stage of use.

For further improvement of this effect, the Type-A Durometer hardness of the outer layer 6 is preferably not less than 45 and not greater than 55, particularly preferably not greater than 50, within the aforementioned range.

The outer layer 6 is formed by preparing a composition by blending a urethane thermoplastic elastomer as a base polymer and an additive component such as a plasticizer, forming the composition into a tubular body, for example, through an injection molding process and, as required, cutting the tubular body to a predetermined length and polishing the outer peripheral surface.

The outer layer 6 preferably has a thickness of not less than 2 mm and not greater than 5 mm as measured radially of the roller body 3.

If the thickness of the outer layer 6 is less than the aforementioned range, the roller body 3 is likely to have a shorter service life because of early abrasion of its outer peripheral surface. If the thickness of the outer layer 6 is greater than the aforementioned range, it will be impossible to sufficiently provide the effect of the double-layer structure including the inner layer 7 and the outer layer 6.

In order to impart the outer layer 6 with a Type-A Durometer hardness of not less than 40 and not greater than 65, it is preferred to use a urethane thermoplastic elastomer having a Type-A Durometer hardness of not less than 60 and not greater than 80 as the base polymer, and to blend not less than 30 parts by mass and not greater than 110 parts by mass of a plasticizer with 100 parts by mass of the urethane thermoplastic elastomer.

As the proportion of the plasticizer is increased within the aforementioned range, the outer layer 6 becomes softer, i.e., the Type-A Durometer hardness of the outer layer 6 is reduced.

The proportion of the plasticizer is preferably not less than 33 parts by mass and not greater than 100 parts by mass, more preferably not less than 52 parts by mass, particularly preferably not less than 61 parts by mass and not greater than 77 parts by mass, within the aforementioned range.

(Urethane Thermoplastic Elastomer)

Examples of the urethane thermoplastic elastomer include various polyurethane thermoplastic elastomers which each include a hard segment having a polyurethane structure and a soft segment having a polyester or polyether structure in a molecule thereof, and have a thermoplastic property allowing for injection molding, an elastic property ensuring proper function of the outer layer 6 of the roller body 3, and a Type-A Durometer hardness of not less than 60 and not greater than 80 as described above.

Specific examples of the urethane thermoplastic elastomer include TPUs each having a relatively low hardness, such as ELASTORAN (registered trade name) C60A10WN (containing a plasticizer and having a Type-A Durometer hardness of 65±4), ELASTORAN C70A10WN (containing a plasticizer and having a Type-A Durometer hardness of 73±4), ELASTORAN C70A11FG (containing no plasticizer and having a Type-A Durometer hardness of 75±3) and ELASTORAN ET870-11V (containing no plasticizer and having a Type-A Durometer hardness of 71±3) available from BASF Japan Ltd., which may be used either alone or in combination.

(Plasticizer)

Examples of the plasticizer include SANFLEX (registered trade name) EB-200, SANFLEX EB-300 and SANFLEX EB-400 (polyethylene glycol dibenzoates) available from Sanyo Chemical Industries Ltd., and BENZOFLEX (registered trade name) 9-88 (dipropylene glycol dibenzoate) available from Eastman Chemical Company, which may be used either alone or in combination.

As the proportion of the plasticizer to be blended is increased, the outer layer 6 becomes softer, i.e., the Type-A Durometer hardness of the outer layer 6 is reduced as described above.

The structure of the sheet conveying roller according to the present invention is not limited to that described above with reference to the drawing.

For example, the inner layer 7 and the outer layer 6 may each have a multilayer structure including two or more layers.

The outer layer 6 may have a recess such as a groove provided in the outer peripheral surface 2. With the provision of the recess, paper dust and the like occurring from paper sheets can be taken into the recess, thereby suppressing reduction in friction coefficient which may otherwise occur due to adhesion of the paper dust on the outer peripheral surface 2. This ensures proper sheet conveyance for a longer period of time.

Further, the shaft 5 may have a shape other than a cylindrical shape, for example, a polygonal prismatic shape, for connection to a driving mechanism not shown.

It should be understood that various design modifications may be made within the scope of the present invention.

The inventive sheet conveying roller 1 is incorporated in a sheet conveying mechanism provided, for example, in an image forming apparatus such as an electrostatic copying machine, a laser printer, a plain paper facsimile machine, a copier-printer-facsimile multifunction machine or an inkjet printer, or machinery such as an automatic teller machine (ATM). The inventive sheet conveying roller 1 can be used as any of various sheet conveying rollers such as a sheet feed roller, a transport roller, a platen roller and a sheet output roller.

EXAMPLES

<Formation of Outer Layer (A)>

First, 100 parts by mass of urethane thermoplastic elastomer pellets (ELASTORAN (registered trade name) C70A11FG containing no plasticizer and having a Type-A Durometer hardness of 75±3 and available from BASF Japan Ltd.) as a base polymer and 67 parts by mass of a plasticizer (polyethylene glycol dibenzoates SANFLEX (registered trade name) EB-300 available from Sanyo Chemical Industries Ltd.) were put in a pail can, and maintained at 80° C. for 15 hours with heating, whereby the pellets were impregnated with the plasticizer.

Then, all the ingredients in the pail can, i.e., the pellets impregnated with the plasticizer and a part of the plasticizer remaining after the impregnation of the pellets, were fed into a twin screw extruder (having a screw diameter of 30 mm, an L/D ratio of 36D and a rotation speed of 10 to 300 rmp). Then, the resulting mixture was continuously extruded while being kneaded, and then pelletized. Thus, pellets of an elastomer composition were prepared.

Then, the pellets were fed into a 50-ton injection molding machine (available from Sumitomo Heavy Industries Co., Ltd.), and the resulting melt was injection-molded into a tubular body having an inner diameter of 16.0 mm, an outer diameter of 23.2 mm and a length of 40 mm. Subsequently, the tubular body was annealed at 80° C. for 15 hours, and then cut to a length of 30 mm. Thus, the outer layer (A) was formed. The cut core diameter was 16.8 mm.

The outer layer (A) had a Type-A Durometer hardness of 47 as measured at 23° C. by a measurement method specified by Japanese Industrial Standards JIS K6253:2006 "Rubber, vulcanized or thermoplastic—determination of hardness—Part 3: Durometer Hardness."

<Formation of Outer Layer (B)>

An outer layer (B) having the same shape and the same size as the outer layer (A) was formed in substantially the same manner as the outer layer (A), except that the plasticizer was used in a proportion of 100 parts by mass based on 100 parts by mass of the urethane thermoplastic elastomer.

The outer layer (B) had a Type-A Durometer hardness of 40 as measured at 23° C. by the aforementioned measurement method.

<Formation of Outer Layer (C)>

An outer layer (C) having the same shape and the same size as the outer layer (A) was formed in substantially the same manner as the outer layer (A), except that the plasticizer was used in a proportion of 130 parts by mass based on 100 parts by mass of the urethane thermoplastic elastomer.

The outer layer (C) had a Type-A Durometer hardness of 35 as measured at 23° C. by the aforementioned measurement method.

<Formation of Outer Layer (D)>

An outer layer (D) having the same shape and the same size as the outer layer (A) was formed in substantially the same manner as the outer layer (A), except that the plasticizer was used in a proportion of 33 parts by mass based on 100 parts by mass of the urethane thermoplastic elastomer.

The outer layer (D) had a Type-A Durometer hardness of 65 as measured at 23° C. by the aforementioned measurement method.

<Formation of Outer Layer (E)>

An outer layer (E) having the same shape and the same size as the outer layer (A) was formed in substantially the same manner as the outer layer (A), except that the plasticizer was used in a proportion of 20 parts by mass based on 100 parts by mass of the urethane thermoplastic elastomer.

The outer layer (E) had a Type-A Durometer hardness of 70 as measured at 23° C. by the aforementioned measurement method.

<Formation of Outer Layer (F)>

An outer layer (F) having the same shape and the same size as the outer layer (A) was formed in substantially the same manner as the outer layer (A), except that the plasticizer was used in a proportion of 75 parts by mass based on 100 parts by mass of the urethane thermoplastic elastomer.

The outer layer (F) had a Type-A Durometer hardness of 45 as measured at 23° C. by the aforementioned measurement method.

<Formation of Outer Layer (G)>

An outer layer (G) having the same shape and the same size as the outer layer (A) was formed in substantially the same manner as the outer layer (A), except that the plasticizer was used in a proportion of 40 parts by mass based on 100 parts by mass of the urethane thermoplastic elastomer.

The outer layer (G) had a Type-A Durometer hardness of 55 as measured at 23° C. by the aforementioned measurement method.

<Formation of Inner Layer (a)>

A rubber composition was prepared by blending the following ingredients:

TABLE 1

| Ingredients | Parts by mass |
|---|---|
| IIR | 100 |
| Carbon black | 5 |
| Paraffin oil | 35 |
| Zinc oxide | 5 |
| Stearic acid | 1 |
| Sulfur powder | 1 |
| Accelerating agent TBT-N | 2 |
| Accelerating agent DM | 1 |

The ingredients shown in Table 1 are as follows: IIR: JSR BUTYL 268 (stabilizer NS type having an unsaturation degree of 1.5 mol %, a Mooney viscosity of 51 $ML_{1+8}$ (at 125° C.) and a specific gravity of 0.92) Carbon black: HAF SEAST3 available from Tokai Carbon Co., Ltd.

Paraffin oil: DIANA (registered trade name) PROCESS OIL PW-380 available from Idemitsu kosan Co., Ltd.

Zinc oxide: Acceleration assisting agent ZINC OXIDE TYPE-2 available from Mitsui Mining & Smelting Co., Ltd.

Stearic acid: Acceleration assisting agent available under the trade name TSUBAKI from NOF Corporation Sulfur powder: Crosslinking agent available from Tsurumi Kagaku Kogyo Co., Ltd.

Accelerating Agent TBT-N: Tetrabutylthiuram disulfide NOCCELER (registered trade name) TBT-N available from Ouchi Shinko Chemical Industrial Co., Ltd.

Accelerating agent DM: Di-2-benzothiazolyl disulfide NOCCELER DM available from Ouchi Shinko Chemical Industrial Co., Ltd.

Then, the resulting rubber composition was fed in a mold, and press-crosslinked at 160° C. under pressure for 30 minutes. Thus, a tubular body was produced, which had an inner diameter of 13.3 mm, an outer diameter of 16.8 mm and a length of 60 mm, and then cut to a length of 30 mm. Thus, an inner layer (a) was formed.

The inner layer (a) had a Type-A Durometer hardness of 15 as measured at 23° C. by the aforementioned measurement method.

<Formation of Inner Layer (b)>

An inner layer (b) having the same shape and the same size as the inner layer (a) was formed in substantially the same manner as the inner layer (a), except that the paraffin oil was used in a proportion of 55 parts by mass based on 100 parts by mass of the IIR.

The inner layer (b) had a Type-A Durometer hardness of 10.5 as measured at 23° C. by the aforementioned measurement method.

<Formation of Inner Layer (c)>

An inner layer (c) having the same shape and the same size as the inner layer (a) was formed in substantially the same manner as the inner layer (a), except that the paraffin oil was used in a proportion of 65 parts by mass based on 100 parts by mass of the IIR.

The inner layer (c) had a Type-A Durometer hardness of 5 as measured at 23° C. by the aforementioned measurement method.

<Formation of Inner Layer (d)>

An inner layer (d) having the same shape and the same size as the inner layer (a) was formed in substantially the same manner as the inner layer (a), except that the paraffin oil was used in a proportion of 10 parts by mass based on 100 parts by mass of the IIR.

The inner layer (d) had a Type-A Durometer hardness of 25 as measured at 23° C. by the aforementioned measurement method.

<Formation of Inner Layer (e)>

An inner layer (e) having the same shape and the same size as the inner layer (a) was formed in substantially the same manner as the inner layer (a), except that no paraffin oil was blended.

The inner layer (e) had a Type-A Durometer hardness of 35 as measured at 23° C. by the aforementioned measurement method.

<Formation of Inner Layer (f)>

A rubber composition was prepared by blending the following ingredients:

TABLE 2

| Ingredients | Parts by mass |
|---|---|
| Oil-extension EPDM | 200 |
| Carbon black | 40 |
| Paraffin oil | 180 |
| Zinc oxide | 5 |
| Stearic acid | 1 |
| Sulfur powder | 1 |
| Accelerating agent TET | 2 |
| Accelerating agent MBTS | 1 |

In Table 2, carbon black, paraffin oil, zinc oxide, stearic acid and sulfur powder are the same as those for the inner layer (a), and the other ingredients are as follows:

Oil extension EPDM: ESPRENE (registered trade name) 670F (having a mass ratio of rubber component:extension oil=100:100) available from Sumitomo Chemical Co., Ltd.

Accelerating Agent TET: Tetraethylthiuram disulfide NOCCELER TET available from Ouchi Shinko Chemical Industrial Co., Ltd.

Accelerating agent MBTS: Di-2-benzothiazolyl disulfide NOCCELER DM-P available from Ouchi Shinko Chemical Industrial Co., Ltd.

Then, an inner layer (f) having the same shape and the same size as the inner layer (a) was formed in substantially the same manner as the inner layer (a), except that the rubber composition thus prepared was used.

The inner layer (f) had a Type-A Durometer hardness of 15 as measured at 23° C. by the aforementioned measurement method.

<Formation of Inner Layer (g)>

An inner layer (g) having the same shape and the same size as the inner layer (a) was formed in substantially the same manner as the inner layer (f), except that the paraffin oil was used in a proportion of 190 parts by mass based on 200 parts by mass of the oil extension EPDM.

The inner layer (g) had a Type-A Durometer hardness of 18 as measured at 23° C. by the aforementioned measurement method.

Example 1

The inner layer (a) (having a Type-A Durometer hardness of 15) was squeezed into a through-hole of the outer layer (A) (having a Type-A Durometer hardness of 47) with a shaft inserted in a through-hole of the inner layer (a). In this manner, sheet conveying rollers were produced, which each included a roller body having a double-layer structure including the inner layer (a) and the outer layer (A).

Example 2

Sheet conveying rollers were each produced in substantially the same manner as in Example 1, except that the inner layer (b) (having a Type-A Durometer hardness of 10.5) was used instead of the inner layer (a). The sheet conveying rollers thus produced each included a roller body having a double-layer structure including the inner layer (b) and the outer layer (A).

Example 3

Sheet conveying rollers were each produced in substantially the same manner as in Example 1, except that the inner layer (d) (having a Type-A Durometer hardness of 25) was used instead of the inner layer (a). The sheet conveying rollers thus produced each included a roller body having a double-layer structure including the inner layer (d) and the outer layer (A).

Example 4

Sheet conveying rollers were each produced in substantially the same manner as in Example 1, except that the inner layer (f) (having a Type-A Durometer hardness of 15) was used instead of the inner layer (a). The sheet conveying rollers thus produced each included a roller body having a double-layer structure including the inner layer (f) and the outer layer (A).

Example 5

Sheet conveying rollers were each produced in substantially the same manner as in Example 1, except that the outer layer (B) (having a Type-A Durometer hardness of 40) was used instead of the outer layer (A). The sheet conveying rollers thus produced each included a roller body having a double-layer structure including the inner layer (a) and the outer layer (B).

Example 6

Sheet conveying rollers were each produced in substantially the same manner as in Example 1, except that the outer layer (D) (having a Type-A Durometer hardness of 65) was used instead of the outer layer (A). The sheet conveying rollers thus produced each included a roller body having a double-layer structure including the inner layer (a) and the outer layer (D).

Example 7

Sheet conveying rollers were each produced in substantially the same manner as in Example 1, except that the outer layer (F) (having a Type-A Durometer hardness of 45) was used instead of the outer layer (A) and the inner layer (b) (having a Type-A Durometer hardness of 10.5) was used instead of the inner layer (a). The sheet conveying rollers thus produced each included a roller body having a double-layer structure including the inner layer (b) and the outer layer (F).

Example 8

Sheet conveying rollers were each produced in substantially the same manner as in Example 1, except that the outer layer (D) (having a Type-A Durometer hardness of 65) was used instead of the outer layer (A) and the inner layer (b) (having a Type-A Durometer hardness of 10.5) was used instead of the inner layer (a). The sheet conveying rollers thus produced each included a roller body having a double-layer structure including the inner layer (b) and the outer layer (D).

Example 9

Sheet conveying rollers were each produced in substantially the same manner as in Example 1, except that the outer layer (F) (having a Type-A Durometer hardness of 45) was used instead of the outer layer (A) and the inner layer (d) (having a Type-A Durometer hardness of 25) was used instead of the inner layer (a). The sheet conveying rollers thus produced each included a roller body having a double-layer structure including the inner layer (d) and the outer layer (F).

Example 10

Sheet conveying rollers were each produced in substantially the same manner as in Example 1, except that the outer layer (D) (having a Type-A Durometer hardness of 65) was used instead of the outer layer (A) and the inner layer (d) (having a Type-A Durometer hardness of 25) was used instead of the inner layer (a). The sheet conveying rollers thus produced each included a roller body having a double-layer structure including the inner layer (d) and the outer layer (D).

Example 11

Sheet conveying rollers were each produced in substantially the same manner as in Example 1, except that the outer layer (G) (having a Type-A Durometer hardness of 55) was used instead of the outer layer (A) and the inner layer (g) (having a Type-A Durometer hardness of 18) was used instead of the inner layer (a). The sheet conveying rollers thus produced each included a roller body having a double-layer structure including the inner layer (g) and the outer layer (G).

Comparative Example 1

Sheet conveying rollers were each produced in substantially the same manner as in Example 1, except that the outer layer (B) (having a Type-A Durometer hardness of 40) was used instead of the outer layer (A) and the inner layer (c) (-having a Type-A Durometer hardness of 5) was used instead of the inner layer (a). The sheet conveying rollers thus produced each included a roller body having a double-layer structure including the inner layer (c) and the outer layer (B).

Comparative Example 2

Sheet conveying rollers were each produced in substantially the same manner as in Example 1, except that the inner layer (c) (having a Type-A Durometer hardness of 5) was used instead of the inner layer (a). The sheet conveying rollers thus produced each included a roller body having a double-layer structure including the inner layer (c) and the outer layer (A).

Comparative Example 3

Sheet conveying rollers were each produced in substantially the same manner as in Example 1, except that the outer layer (E) (having a Type-A Durometer hardness of 70) was used instead of the outer layer (A) and the inner layer (c) (having a Type-A Durometer hardness of 5) was used instead of the inner layer (a). The sheet conveying rollers thus produced each included a roller body having a double-layer structure including the inner layer (c) and the outer layer (E).

Comparative Example 4

Sheet conveying rollers were each produced in substantially the same manner as in Example 1, except that the outer layer (E) (having a Type-A Durometer hardness of 70) was used instead of the outer layer (A) The sheet conveying rollers thus produced each included a roller body having a double-layer structure including the inner layer (a) and the outer layer (E).

Comparative Example 5

Sheet conveying rollers were each produced in substantially the same manner as in Example 1, except that the inner layer (e) (having a Type-A Durometer hardness of 35) was used instead of the inner layer (a). The sheet conveying rollers thus produced each included a roller body having a double-layer structure including the inner layer (e) and the outer layer (A).

Comparative Example 6

Sheet conveying rollers were each produced in substantially the same manner as in Example 1, except that the outer layer (E) (having a Type-A Durometer hardness of 70) was used instead of the outer layer (A) and the inner layer (e) (having a Type-A Durometer hardness of 35) was used instead of the inner layer (a). The sheet conveying rollers thus produced each included a roller body having a double-layer structure including the inner layer (e) and the outer layer (E).

<Evaluation for Abrasion Resistance>

The sheet conveying rollers produced in each of the inventive examples and the comparative examples were each weighed, and then incorporated as sheet feed rollers called "pickup roller", "feed roller" and "retard roller" in a main body cassette of a multifunction machine (HP LaserJet P4515n available from Japan Hewlett Packard Co., Ltd.)

After 100,000 copy sheets (GF500 available from Canon Inc.) were sequentially conveyed by the sheet conveying rollers, the sheet conveying rollers were each weighed again. Then, an abrasion weight W1 (mg) observed during the conveyance of the sheets was determined. The retard roller was evaluated for the abrasion resistance. A reference sheet conveying roller was produced which included a single-layer roller body formed from the same material as that for the outer layer of each of the inventive examples and the comparative examples. Then, an abrasion weight W0 (mg) observed during the conveyance of sheets by the reference sheet conveying roller was determined. For the abrasion resistance evaluation, the abrasion weight reduction percentage (%) of the abrasion weight W1 to the abrasion weight W0 was determined from the following expression:

$$\text{Reduction percentage (\%)} = W0 - W1 / W0 \times 100 \quad (1)$$

A sheet conveying roller having an abrasion weight reduction percentage of not less than 30% was rated as excellent (○), and a sheet conveying roller having an abrasion weight reduction percentage of less than 30% was rated as unacceptable (×).

<Evaluation for Inter-Layer Slip-Rotation>

The shaft of the sheet conveying roller produced in each of the inventive examples and the comparative examples was fixed to a torque gage (BTG90CN-S available from Tohnichi Manufacturing Co., Ltd.) In this state, the torque gage and the roller body of the sheet conveying roller were twisted in opposite directions about the center axis of the shaft at a rotation speed of 30 rpm. At this time, a maximum torque observed before the inter-layer slip-rotation between the inner layer and the outer layer of the roller body was determined as a slippage torque. A sheet conveying roller having a slippage torque of not less than 30 cN·m was rated as acceptable (○) with no slip-rotation, and a sheet conveying roller having a slippage torque of less than 30 cN·m was rated as unacceptable (×) with slip-rotation.

<Evaluation for Squeal Resistance>

The sheet conveying rollers produced in each of the inventive examples and the comparative examples were each weighed, and then incorporated as sheet feed rollers called "pickup roller", "feed roller" and "retard roller" in a main body cassette of a multifunction machine (HP LaserJet P4515n available from Japan Hewlett Packard Co., Ltd.).

While 1,000 copy sheets (GF500 available from Canon Inc.) were sequentially conveyed by the sheet conveying rollers, the sheet conveying rollers were observed for squeal resistance. A sheet conveying roller suffering from squeal was rated as unacceptable (×), and a sheet conveying roller not suffering from squeal was rated as excellent (○).

<Measurement of Initial Friction Coefficient>

Figure 2:
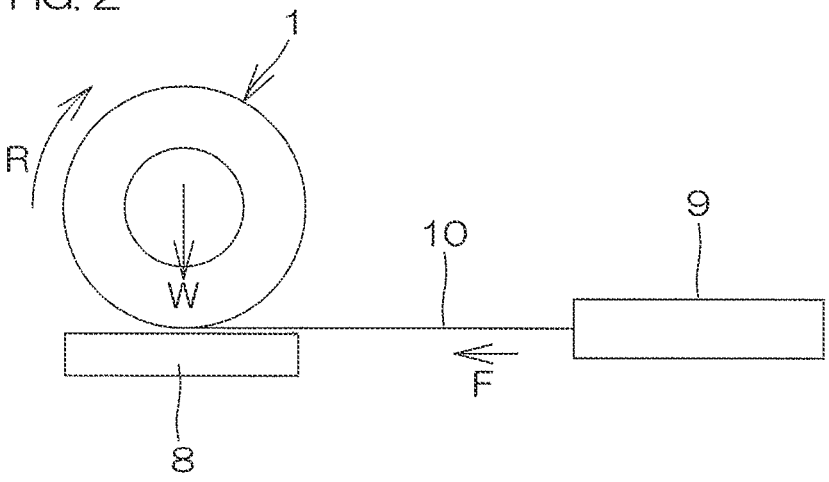
FIG. 2 is a diagram for explaining how to measure the initial friction coefficient of sheet conveying rollers produced in inventive examples and comparative examples.

FIG. 2 is a diagram for explaining how to measure the initial friction coefficient of each of the sheet conveying rollers produced in the inventive examples and the comparative examples.

Referring to FIG. 2, one end portion of a P-paper sheet (available from Fuji Xerox Co., Ltd.) having a size of 60 mm×210 mm was connected to a load cell 9, and the other end portion of the P-paper sheet was held between a plate 8 of polytetrafluoroethylene (PTFE) fixed in position and a sheet conveying roller 1 to be subjected to measurement of the friction coefficient. In this state, a vertical load W of 0.98 N (=100 gf) was applied from the sheet conveying roller toward the plate 8.

In this state, the sheet conveying roller 1 was rotated at a circumferential speed of 300 mm/sec in a direction indicated by an arrow R at a temperature of 23° C. at a relative humidity of 55%, and a transport force F (gf) acting on the load cell 9 was measured.

The friction coefficient p was determined from the following expression (2) based on the transport force F and the vertical load W (=100 gf):

$$\mu = F(\text{gf})/100(\text{gf}) \quad (2)$$

The results are shown in Tables 3 to 5.

In these tables, "TPU" means a urethane thermoplastic elastomer. "Hardness" was a Type-A Durometer hardness.

TABLE 3

| | Example | | | | | |
|---|---|---|---|---|---|---|
| | 1 | 2 | 3 | 4 | 5 | 6 |
| **Outer layer** | | | | | | |
| Type | A | A | A | A | B | D |
| Base polymer | TPU | TPU | TPU | TPU | TPU | TPU |
| Hardness | 47 | 47 | 47 | 47 | 40 | 65 |
| **Inner layer** | | | | | | |
| Type | a | b | d | f | a | a |
| Base polymer | IIR | IIR | IIR | EPDM | IIR | IIR |
| Hardness | 15 | 10.5 | 25 | 15 | 15 | 15 |

TABLE 3-continued

| | Example | | | | | |
|---|---|---|---|---|---|---|
| | 1 | 2 | 3 | 4 | 5 | 6 |
| **Evaluation** | | | | | | |
| Abrasion resistance | ○ | ○ | ○ | ○ | ○ | ○ |
| Slip-rotation | ○ | ○ | ○ | ○ | ○ | ○ |
| Squeal | ○ | ○ | ○ | ○ | ○ | ○ |
| Friction coefficient | 1.9 | 2.0 | 1.8 | 1.9 | 1.7 | 1.7 |

TABLE 4

| | Example | | | | |
|---|---|---|---|---|---|
| | 7 | 8 | 9 | 10 | 11 |
| **Outer layer** | | | | | |
| Type | F | D | F | D | G |
| Base polymer | TPU | TPU | TPU | TPU | TPU |
| Hardness | 45 | 65 | 45 | 65 | 55 |
| **Inner layer** | | | | | |
| Type | b | b | d | d | g |
| Base polymer | IIR | IIR | IIR | IIR | EPDM |
| Hardness | 10.5 | 10.5 | 25 | 25 | 18 |
| **Evaluation** | | | | | |
| Abrasion resistance | ○ | ○ | ○ | ○ | ○ |
| Slip-rotation | ○ | ○ | ○ | ○ | ○ |
| Squeal | ○ | ○ | ○ | ○ | ○ |
| Friction coefficient | 2.0 | 1.8 | 1.9 | 1.6 | 1.8 |

TABLE 5

| | Comparative Example | | | | | |
|---|---|---|---|---|---|---|
| | 1 | 2 | 3 | 4 | 5 | 6 |
| **Outer layer** | | | | | | |
| Type | B | A | E | E | A | E |
| Base polymer | TPU | TPU | TPU | TPU | TPU | TPU |
| Hardness | 40 | 47 | 70 | 70 | 47 | 70 |
| **Inner layer** | | | | | | |
| Type | c | c | c | a | e | e |
| Base polymer | IIR | IIR | IIR | IIR | IIR | IIR |
| Hardness | 5 | 5 | 5 | 15 | 35 | 35 |
| **Evaluation** | | | | | | |
| Abrasion resistance | — | — | — | ○ | ○ | ○ |
| Slip-rotation | x | x | x | ○ | ○ | ○ |
| Squeal | — | — | — | x | x | x |
| Friction coefficient | — | — | — | 1.7 | 1.7 | 1.6 |

The results for Comparative Examples 1 to 3 in Table 5 indicate that, where the roller body of the sheet conveying roller has a double-layer structure including a tubular outer layer of a urethane thermoplastic elastomer and a tubular inner layer of a rubber (IIR) inserted directly in the tubular outer layer without the intervention of an adhesive agent and the inner layer is imparted with a type-A Durometer hardness of not greater than 10, the slip-rotation is liable to occur between the inner layer and the outer layer because the oil is contained in a greater amount in the inner layer. For this reason, the evaluation tests other than the slip-rotation test were not performed on Comparative Examples 1 to 3.

The results for Comparative Examples 4 to 6 indicate that, where the outer layer has a type-A Durometer hardness of greater than 65 (Comparative example 4) or the inner layer has a type-A Durometer hardness of greater than 25 (Comparative Example 5), or where the outer layer has a type-A Durometer hardness of greater than 65 and the inner layer has a type-A Durometer hardness of greater than 25 (Comparative Example 6), the sheet conveying roller is liable to suffer from the squeal and the reduction in friction coefficient.

In contrast, the results for Examples 1 to 11 in Tables 3 and 4 indicate that, where the outer layer has a type-A Durometer hardness of not less than 40 and not greater than 65 and the inner layer has a type-A Durometer hardness of greater than 10 and not greater than 25, the sheet conveying roller is excellent in various characteristic properties without the reduction in friction coefficient and the squeal, and free from slip-rotation between the inner layer and the outer layer.

The results for the inventive examples indicate that the type-A Durometer hardness of the outer layer is preferably not less than 45 and not greater than 55, particularly preferably not greater than 50, within the aforementioned range, and the type-A Durometer hardness of the inner layer is preferably not less than 10.5 and not greater than 20, particularly preferably not less than 13 and not greater than 18, within the aforementioned range.

The results for the inventive examples indicate that the composition for the outer layer is preferably prepared by blending not less than 30 parts by mass and not greater than 110 parts by mass of a plasticizer with 100 parts by mass of a urethane thermoplastic elastomer having a type-A Durometer hardness of not less than 60 and not greater than 80.

This application corresponds to Japanese Patent Application No. 2013-147729 filed in the Japan Patent Office on Jul. 16, 2013, the disclosure of which is incorporated herein by reference in its entirety.

What is claimed is:

1. A sheet conveying roller comprising a tubular roller body, which includes:

a tubular outer layer defining an outer peripheral surface of the roller body; and a tubular inner layer inserted directly in the tubular outer layer without the intervention of an adhesive agent and unified with the outer layer;

wherein the outer layer is a nonporous tubular layer made of a composition comprising a urethane thermoplastic elastomer as a base polymer, the urethane thermoplastic elastomer including a hard segment having a polyurethane structure and a soft segment having a polyester or polyether structure in a molecule thereof, and has a Type-A Durometer hardness of not less than 40 and not greater than 65;

wherein the inner layer is a nonporous tubular layer made of a crosslinking product of a composition comprising a butyl rubber or an ethylene propylene rubber as a base polymer, and has a Type-A Durometer hardness of greater than 10 and not greater than 25.

2. The sheet conveying roller according to claim 1, wherein the outer layer is formed of a composition prepared by blending not less than 30 parts by mass and not greater than 110 parts by mass of a plasticizer with 100 parts by mass of a urethane thermoplastic elastomer having a Type-A Durometer hardness of not less than 60 and not greater than 80.

3. The sheet conveying roller according to claim 1, wherein the inner layer has a thickness of not less than 1 mm and not greater than 3 mm as measured radially of the roller body, and wherein the outer layer has a thickness of not less than 2 mm and not greater than 5 mm as measured radially of the roller body.

* * * * *